US005116058A

United States Patent [19]

Theriault

[11] Patent Number: 5,116,058

[45] Date of Patent: May 26, 1992

[54] GOLF SWING TRAINING DEVICE

[76] Inventor: Joseph H. Theriault, 424 Emerson Dr., Raleigh, N.C. 27609

[21] Appl. No.: 721,952

[22] Filed: Jun. 27, 1991

[51] Int. Cl.[5] ..... A63B 69/36

[52] U.S. Cl. ..... 273/183 E; 273/35 A; 273/DIG. 21; 273/187 R; 359/876

[58] Field of Search ..... 273/35 R, 35 A, 35 B, 273/183 E, DIG. 21; 350/632

[56] References Cited

U.S. PATENT DOCUMENTS

| | | | |
|---|---|---|---|
| 4,143,877 | 3/1979 | Jeffries | 273/183 E |
| 4,383,687 | 5/1983 | Wolff | 273/35 A |
| 4,960,278 | 10/1990 | Hainey | 273/DIG. 21 |

FOREIGN PATENT DOCUMENTS

| | | | |
|---|---|---|---|
| 2130103 | 5/1984 | United Kingdom | 273/35 A |
| 2132490 | 7/1984 | United Kingdom | 273/35 A |

*Primary Examiner*—George J. Marlo
*Attorney, Agent, or Firm*—Rhodes, Coats & Bennett

[57] ABSTRACT

A golf training device is disclosed to provide real-time visual feedback regarding the user's golf swing. The golf training device comprises a mirror which is pivotally mounted on a base. The mirror is adjusted by the user so that the user can observe his body during the course of his or her golf swing. The mirror includes a fixed, visual reference to assist the user in recognizing flaws in his or her body movement so that the user can immediately correct his or her golf swing. The fixed reference may, for example, take the form of a centering spot on the mirror which the user may use as a visual reference in centering and aligning his or her body during the course of a golf swing. The centering spot may include an opening through the mirror, which opening helps a golfer square the base by sighting on a reference line on the base and visible through the opening.

15 Claims, 2 Drawing Sheets

GOLF SWING TRAINING DEVICE

FIELD OF THE INVENTION

The present invention relates generally to athletic equipment and more particularly to a golf training device.

BACKGROUND OF THE INVENTION

Golf is a game in which form is emphasized over athletic ability. Proper body alignment throughout the swing is essential to obtain any degree of success in playing golf. Even slight improper twisting of the body can greatly hamper a player's performance.

Repetitive practice is very eefective in develping one's golf game. However, to practice with the wrong form, especially with a form that involves an improper twisting of the body, serves only to engrain bad habits.

The need to eliminate improper twisting has prompted the popular use of video cameras to tape player's swings. Practice techniques using video cameras have very limited effectiveness, however because the golfer cannot observe himself while he or she is being taped and must wait until later to analyze and adjust his stroke. There is a need for a device which provides real time visual feedback on the condition of the golfer's swing from address to follow-through so that immediate corrective action can be taken by the golfer.

SUMMARY AND OBJECTS OF THE INVENTION

The present invention was developed to overcome the aforementioned problems associated with other golf practice techniques. The goal is accomplished by providing a mirror from which a user can observe his body during the course of his or her golf swing. The mirror includes a fixed, visual reference to help the user recognize deviations from a proper swing so that the swing can be adjusted immediately, rather than waiting to review the stroke on tape. The visual reference may, for example, take the form of a centering spot on the mirror which is aligned along the center line of the user's reflection in the mirror. Improper body movement during the course of a golf swing will result in movement of the reflection in relation to the centering spot which indicates some deviation.

Accordingly, it is an object of the present invention to provide a golf training device which allows the golfer to practice his or her golf swing.

Another object of the present invention is to provide a golf training device which allows the user to observe his or her stroke throughout the swing.

Another object of the present invention is to provide a golf training device with a fixed reference point by which the user may recognize his or her deviation from proper form.

Another object of the present invention is to provide a golf training device which is adjustable to the height of the user and may be used to observe various portions of the user's body during the swing.

Another object of the present invention is to provide a golf training device which is relatively simple in construction.

Another object of the present invention is to provide a golf training device which is relatively simple to use and to adjust for optimal effectiveness.

Other objects and advantages of the present invention will become apparent and obvious from a study of the following description and the accompanying drawings which are merely illustrative of such invention.

DETAILED DESCRIPTION OF THE INVENTION

Figure 1:
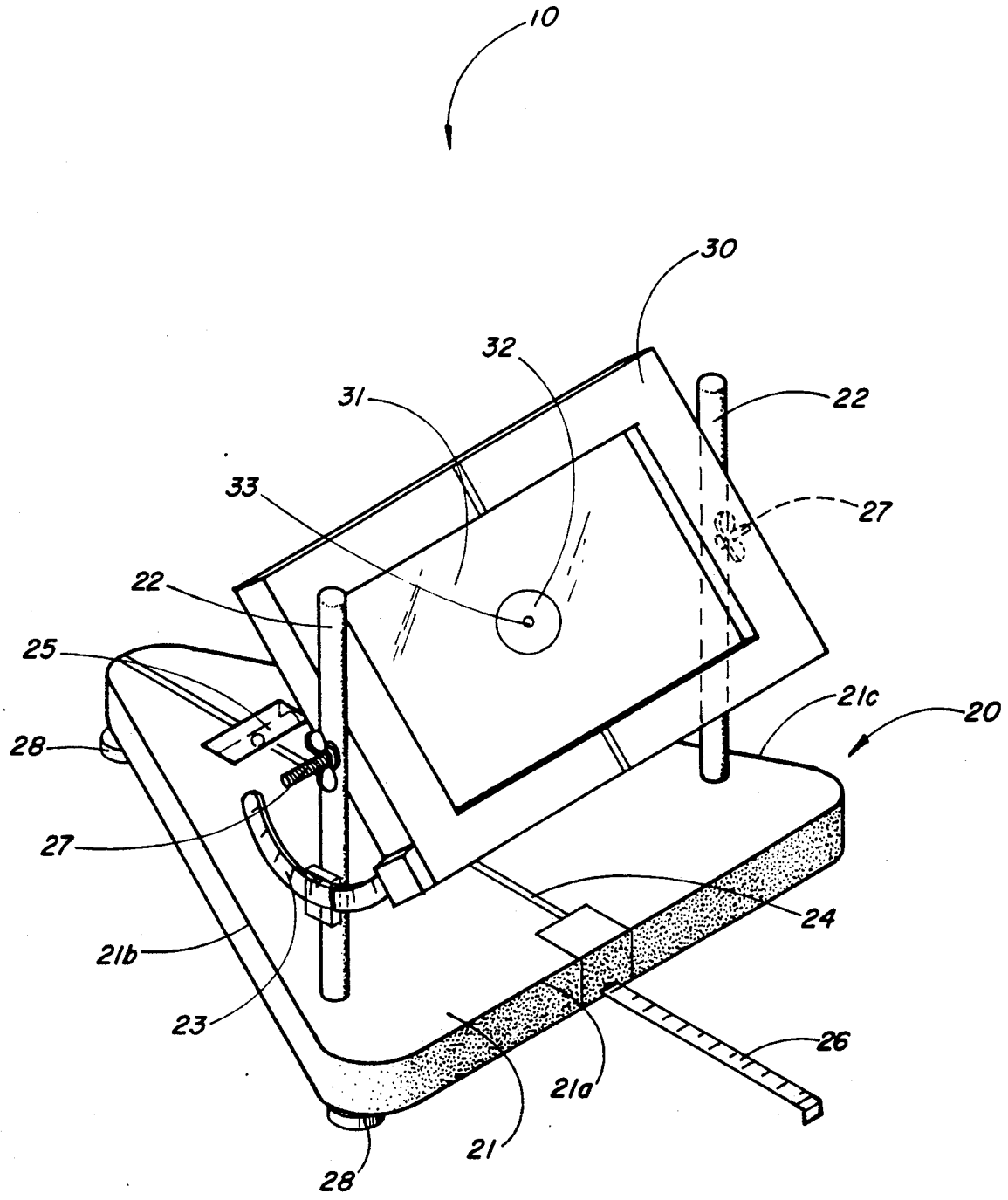

Referring now to the drawings, the golf training device of the present invention is shown therein and indicated generally by numeral 10. The golf training device 10 consists of a mirror assembly 30 supported by a base 20. The base 20 includes a generally triangular, base plate 21 including a front edge 21*a*, and two receding edges 21*b* and 21*c*. A pair of vertical supports 22 extend upwardly from the base plate 21 and are disposed parallel to the forward edge 21*a* of the base plate 21.

Figure 2:
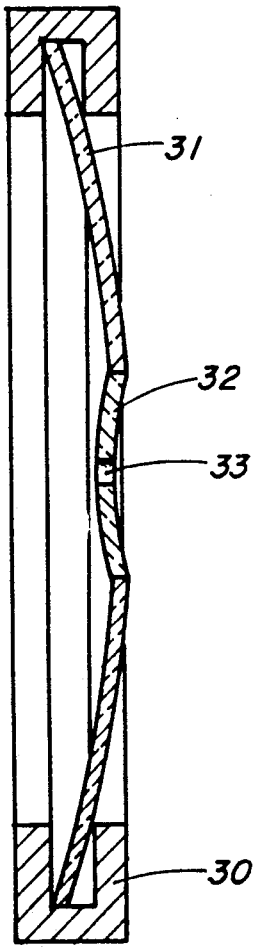
Figure 3:
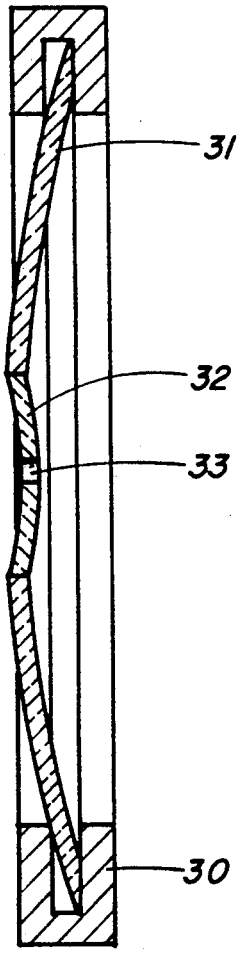

The mirror assembly 30 is preferably constructed from high impact plastic and is pivotally mounted between the supports 22. The mirror assembly 30 includes a mirror 31 which is held at its edges in a frame 34 such that both front and back panels of the mirror 31 are exposed. The mirror 31 may be flat, concave, or convex in shape. A centering spot 32 is formed in the center of the mirror 31. The centering sport 32 may be of various sizes. It may be concave or convex in shape and may be formed from reflective, non-reflective, or translucent material. The centering spot 32 may include a hole 33 formed in the mirror 31. The characteristics of the mirror 31 and centering spot 32 may be chosen to suit the device's application. For example, FIG. 2 shows one embodiment of the invention wherein the mirror 31 is convexly shaped and the centering spot 32 is concavely shaped. FIG. 3 shows another embodiment of the invention wherein the mirror 31 is concavely shaped and the centering spot 32 is convexly shaped. The shape or curvature of the mirror may be adjustable to accentuate the vertical or horizontal views.

The mirror assembly 30 is mounted between the supports 21. Externally threaded studs extend from opposite sides of the frame 34 and pass through openings formed in the vertical supports 21. The mirror assembly 30 is rotatable about the horizontal axis formed by the studs 27. Tightenable fasteners 22, such as wing nuts, can be tightened to secure the mirror assembly in a fixed, angular position. A protractor-type gauge 23 is attached to the mirror assembly 30 at one end and may be used to measure the angle of inclination.

To assist the user in setting up the training device, the base 20 may include a retractable tape measure 26 for measuring the distance from the base 20 to the user. A bubble level 25 and adjustable feet 28 are also provided for levelling the base 20. A centering line 24 extends from a rearmost corner of the base plate 21 and bisects the base plate 21. The centering line 24 helps square the base with the user during set-up by sighting centering line 24 on the base through the hole 33.

To use the training device 10, the user measures the distance from his or her eye level to the ground using the measuring tape 26 and places the training device 10 that distance from his or her stance. The base is squared by sighting the centering line 24 through the hole 33 in the mirror. The mirror assembly 30 is then rotated to a position such that the body part on which the user wishes to focus (i.e. nose, neck, sternum, beltline, hips, etc.) is reflected at the centering spot 32. The user observes himself in the mirror 31 while practicing his or her golf swing. Any deviation from a proper swing becomes apparent. For example, if the user places his nose at the centering spot 32, any deviation in the golfer's swing will cause his reflection to move in relation to the centering spot 32. If the golfer learns to his right during the backswing, his or her reflection will also move to the right of the centering spot to alert the user. Likewise, by focusing the centering spot 32 on his neck or beltline, the golfer will be made aware of any improper twisting or leaning during his or her swing. Since the visual feedback is immediate, the user can take immediate action to correct his or her swing and can use the reference spot in the mirror to help keep his or her body properly aligned. The path of the club is perfected with practice, and muscle memory occurs.

The present invention may, of course, be carried out in other specific ways than those herein set forth without departing from the spirit and essential characteristic of the invention. The present embodiments are, therefore, to be considered in all respects as illustrative and not restrictive and all changes coming within the meaning and equivalency range of the appended claims are intended to be embraced therein.

What is claimed is:

1. A golf swing training device to assist in the development of a proper golf swing comprising:

(a) a base to be placed on the ground and having a centering line which is disposed in a reference plane that extends perpendicular to the golfer's swing plane;

(b) a mirror mounted to said base and angled to permit the user to view himself in said mirror;

(c) a reference mark on said mirror to be aligned with the vertical axis of the user's body; and (d) an opening formed in the mirror through which the centering line on the base is sighted to enable the user to align his stance with respect to the reference plane.

2. The golf swing training device according to claim 1 including adjustable mounting means having two upright support disposed on either side of said mirror and attached to said mirror such that it may be rotated about a horizontal axis.

3. The golf swing training device according to claim 2 wherein said adjusting mounting includes a means for locking the mirror at the desired angle of inclination.

4. The golf swing training device according to claim 1 further including a gauge means for measuring the angle of inclination of the mirror.

5. The golf swing training device according to claim 4 wherein said gauge means comprises a protractor for measuring the angle of inclination.

6. The golf swing training device according to claim 1 further including a tape measure secured to the base for measuring the distance from the base to the user.

7. The golf swing training device according to claim 1 wherein said base includes a bubble leveling device for indicating when the base is level.

8. The golf swing training device according to claim 1 wherein said mirror is concavely formed.

9. The golf swing training device according to claim 1 wherein said mirror is convexly formed.

10. A golf swing training device to assist in the development of a proper golf swing comprising:

(a) a base for placement on the ground, said base having a centering line which is disposed in a reference plane that extends perpendicular to the swing plane;

(b) two supporting posts extending upwardly from said base;

(c) a mirror assembly pivotally mounted between said supporting posts such that said mirror assembly is rotatable about a horizontal axis;

(d) a mirror within said mirror assembly for observing a portion of the user's body throughout the golf swing;

(e) a reference mark on said mirror to provide a visual reference point for aligning the user's body during a golf swing; and (f) an opening formed in the mirror through which the centering line on the base is sighted to enable the user to align his stance with respect to the reference plane.

11. The golf swing training device according to claim 10 wherein said supporting posts include a locking means for locking said mirror assembly at the desired angle of inclination.

12. The golf swing training device according to claim 10 wherein said mirror assembly includes a gauge on one end for measuring the angle of inclination of the mirror.

13. The golf swing training device according to claim 10 wherein said base includes a retractable tape measure for measuring the distance from the base to the user.

14. The golf swing training device according to claim 10 wherein said base includes a bubble level for indicating when the base is level.

15. The golf swing training device according to claim 10 wherein said base includes adjustable feet for levelling the base.

* * * * *